US007119495B2

(12) United States Patent
Jang

(10) Patent No.: US 7,119,495 B2
(45) Date of Patent: Oct. 10, 2006

(54) CONTROLLING A LIGHT ASSEMBLY

(75) Inventor: Hyeon-Yong Jang, Gyeonggi-do (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 10/789,679

(22) Filed: Feb. 27, 2004

(65) Prior Publication Data

US 2004/0183465 A1 Sep. 23, 2004

(30) Foreign Application Priority Data

Feb. 28, 2003 (KR) ..... 10-2003-0012678

(51) Int. Cl.
*H05B 41/36* (2006.01)
*H05B 39/04* (2006.01)

(52) U.S. Cl. ..... 315/244; 315/291

(58) Field of Classification Search ..... 315/224, 315/291, 307, 312, 209 R, DIG. 7
See application file for complete search history.

(56) References Cited

U.S. PATENT DOCUMENTS

| | | | | |
|---|---|---|---|---|
| 4,162,429 | A | 7/1979 | Elms et al. | 315/284 |
| 4,350,934 | A | 9/1982 | Spreadbury | 315/282 |
| 4,421,993 | A | 12/1983 | Bloomer | 307/126 |
| 4,501,994 | A | 2/1985 | Spreadbury | 315/307 |
| 5,004,892 | A | 4/1991 | Goessler et al. | 219/464 |
| 5,973,455 | A * | 10/1999 | Mirskiy et al. | 315/105 |
| 6,259,615 | B1 * | 7/2001 | Lin | 363/98 |
| 6,362,575 | B1 * | 3/2002 | Chang et al. | 315/224 |
| 6,396,722 | B1 * | 5/2002 | Lin | 363/98 |
| 6,472,876 | B1 | 10/2002 | Notohamiprodjo et al. | 324/414 |
| 6,841,952 | B1 * | 1/2005 | Lee | 315/291 |
| 2003/0057888 | A1 * | 3/2003 | Archenhold et al. | 315/291 |
| 2003/0098861 | A1 * | 5/2003 | Nakatsuka et al. | 345/212 |

FOREIGN PATENT DOCUMENTS

| | | |
|---|---|---|
| EP | 1 022 932 | 7/2000 |
| FR | 2 467 441 | 10/1980 |
| WO | WO 02/32196 | 4/2002 |

OTHER PUBLICATIONS

European Search Report dated Nov. 8, 2004.
Office Action mailed on Dec. 15, 2005 corresponding to the related European Patent Application No. 04 004 475.2-2206.

* cited by examiner

*Primary Examiner*—Shih-Chao Chen
*Assistant Examiner*—Minh Dieu A
(74) *Attorney, Agent, or Firm*—MacPherson, Kwok, Chen & Heid LLP

(57) ABSTRACT

A method and apparatus for operating a light assembly with fewer peripheral devices than is currently required is presented. The apparatus of the invention includes a lamp unit, a current restricting unit coupled to the lamp unit, and a current sensing unit that is coupled to the current restricting unit. Upon detecting a current output exceeding a predetermined magnitude for at least a predetermined time period, the current restricting unit increases the load on one of the lamps. The current sensing unit senses the output from each of the lamps as modified by the current restricting unit, and sums the outputs to determine a total current flow through the lamps. A current control unit that is coupled to the current sensing unit uses the total current flow to adjust the current input to the lamps.

27 Claims, 6 Drawing Sheets

CONTROLLING A LIGHT ASSEMBLY

RELATED APPLICATION(S)

This application claims priority, under 35 USC § 119, from Korean Patent Application No. 2003-0012678 filed on Feb. 28, 2003, the contents of which are incorporated herein by reference in its entirety.

BACKGROUND OF THE INVENTION

1. Field of Invention

The present invention relates to an apparatus for driving a light source for a display device.

2. Description of Related Art

There are various types of display devices that are commonly used for computers and television sets. The types of display devices include self-emitting displays such as light emitting diodes (LEDs), electroluminescence devices (ELs), vacuum fluorescent displays (VFDs), field emission displays (FEDs) and plasma panel displays (PDPs), and non-emitting displays such liquid crystal displays (LCDs). Unlike the self-emitting displays, the non-emitting displays require a light source.

An LCD includes two panels with field-generating electrodes and a liquid crystal (LC) layer with dielectric anisotropy interposed therebetween. The field-generating electrodes generate an electric field in the liquid crystal layer in response to applied voltages, and the transmittance of light passing through the panels varies depending on the strength of the electric field. The strength of the electric field is controlled by the applied voltages. Accordingly, desired images are displayed by adjusting the applied voltages.

The light source for an LCD may be an artificial light source that is installed in the LCD device or natural light. When using the artificial light source, the overall brightness of the LCD screen is usually adjusted by either regulating the ratio of "on" and "off" durations of the light source or regulating the current through the light source.

The artificial light source, which is part of a backlight assembly, is often implemented as a plurality of fluorescent lamps that are connected to a plurality of inverters for driving the lamps. The lamps may be disposed under an LC panel assembly, such as in a direct-type backlight assembly, or may be disposed along one or more edges of the LC panel assembly, such as in an edge-type backlight assembly. The inverter receives a DC (direct current) input voltage from an external device and converts it to an AC (alternating current) voltage, and then applies the voltage to the lamps to turn on the lamps and to control the brightness of the lamps. The voltage may be stepped up by a transformer prior to being applied to the lamps. The inverter also monitors a voltage related to a current flowing through the lamps and controls the voltage applied to the lamps based on the monitored voltage.

Accordingly, the artificial light source needs several peripheral devices such as inverters and sensors, which undesirably increase manufacturing cost. Aside from the associated cost increase, the peripheral devices are undesirable because they increase the volume and the weight of the backlight assembly, adversely affecting the mobility of the display device. Thus, a display device design that allows operation with fewer peripheral devices is desirable.

SUMMARY OF THE INVENTION

The invention provides a method of operating a light assembly with fewer peripheral devices than is required by the currently available methods, and an apparatus for operating the light assembly that includes fewer peripheral devices than the conventional apparatus. The apparatus of the invention includes a lamp unit, a current restricting unit for adjusting a load on the lamp unit, and a current sensing unit that is coupled to the current restricting unit. The current sensing unit determines a total current flow through the lamp unit. Based on this total current flow, a current control unit adjusts a current supply to the lamp unit.

In another aspect, the invention is an apparatus including a first lamp and a second lamp coupled in a parallel configuration, a first current restricting subunit that is coupled to the first lamp and a second current restricting subunit that is coupled to the second lamp, and a first current sensing subunit that is coupled to the first lamp and a second current sensing subunit that is coupled to the second lamp. The first current restricting subunit determines a first current flow through the first lamp and the second current restricting subunit determines a second current flow through the second lamp. A current control unit generates a total current flow by summing the first current flow and the second current flow, and adjusts a current supply to the first lamp and the second lamp based on the total current flow.

The invention also includes a method of controlling a light assembly by monitoring a current output from each of a plurality of lamps. Upon detecting a current output exceeding a predetermined magnitude for at least a predetermined time period, a load on one of the lamps is increased. The current output from each of the plurality of lamps is sensed and summed to determine a total current flow through the lamps. Based on the total current flow, current input to the lamps is adjusted.

BRIEF DESCRIPTION OF THE DRAWINGS

The present invention will become more apparent by describing embodiments thereof in detail with reference to the accompanying drawings in which.

DETAILED DESCRIPTION OF PREFERRED EMBODIMENT(S)

Figure 1:
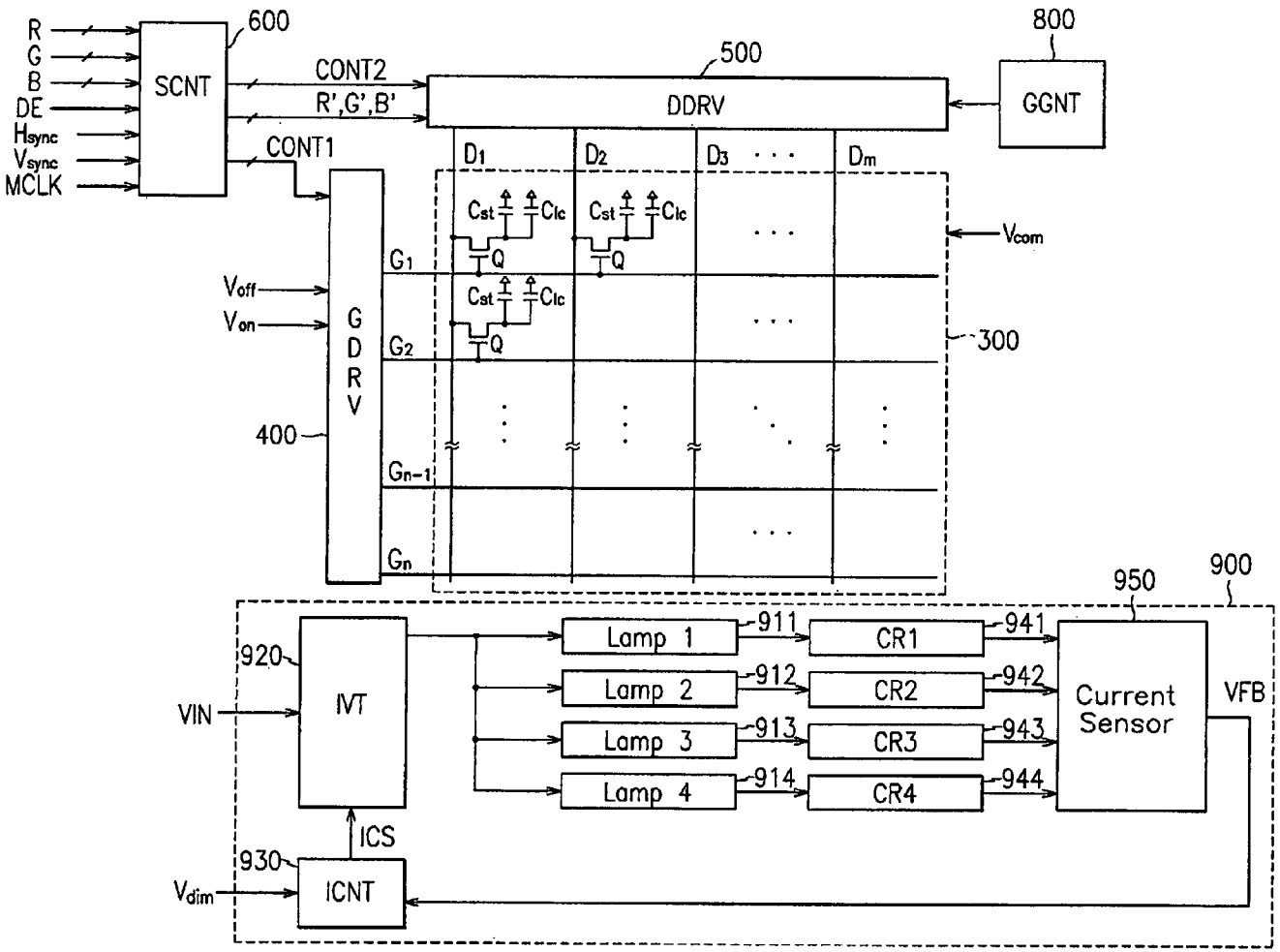
FIG. 1 is a block diagram of an LCD according to an embodiment of the present invention.

Embodiments of the invention are described herein in the context of a LC display device. However, it is to be understood that the embodiments provided herein are just preferred embodiments, and the scope of the invention is not limited to the applications or the embodiments disclosed herein. The present invention will now be described with reference to the accompanying drawings, which portray the preferred embodiments.

In the drawings, the thickness of layers and regions are exaggerated for clarity. Like numerals refer to like elements throughout. As used herein, a "lamp unit" is a set of one or more lamp subunits and a "current restricting unit" is a set of one or more current restricting subunits.

Figure 2:
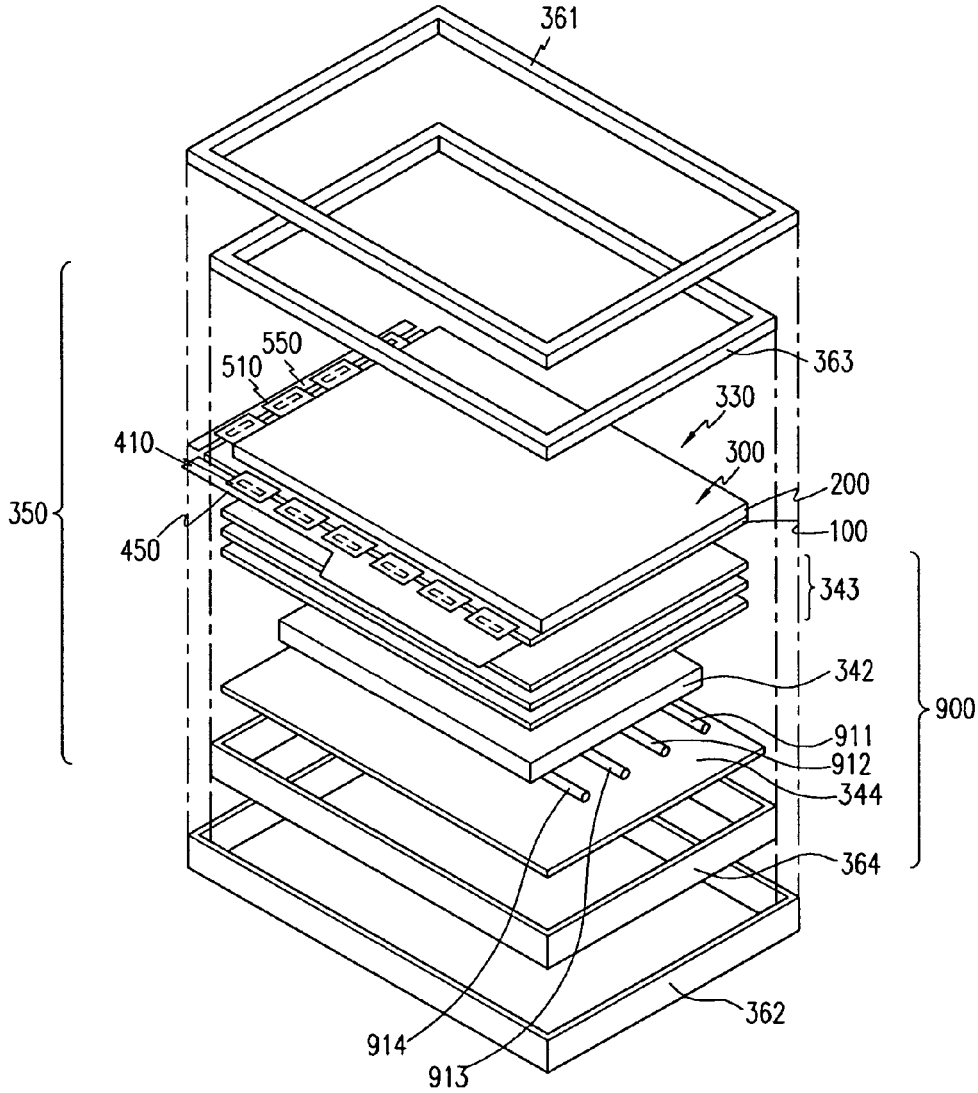
FIG. 2 is an exploded perspective view of an LCD according to an embodiment of the present invention.
Figure 3:
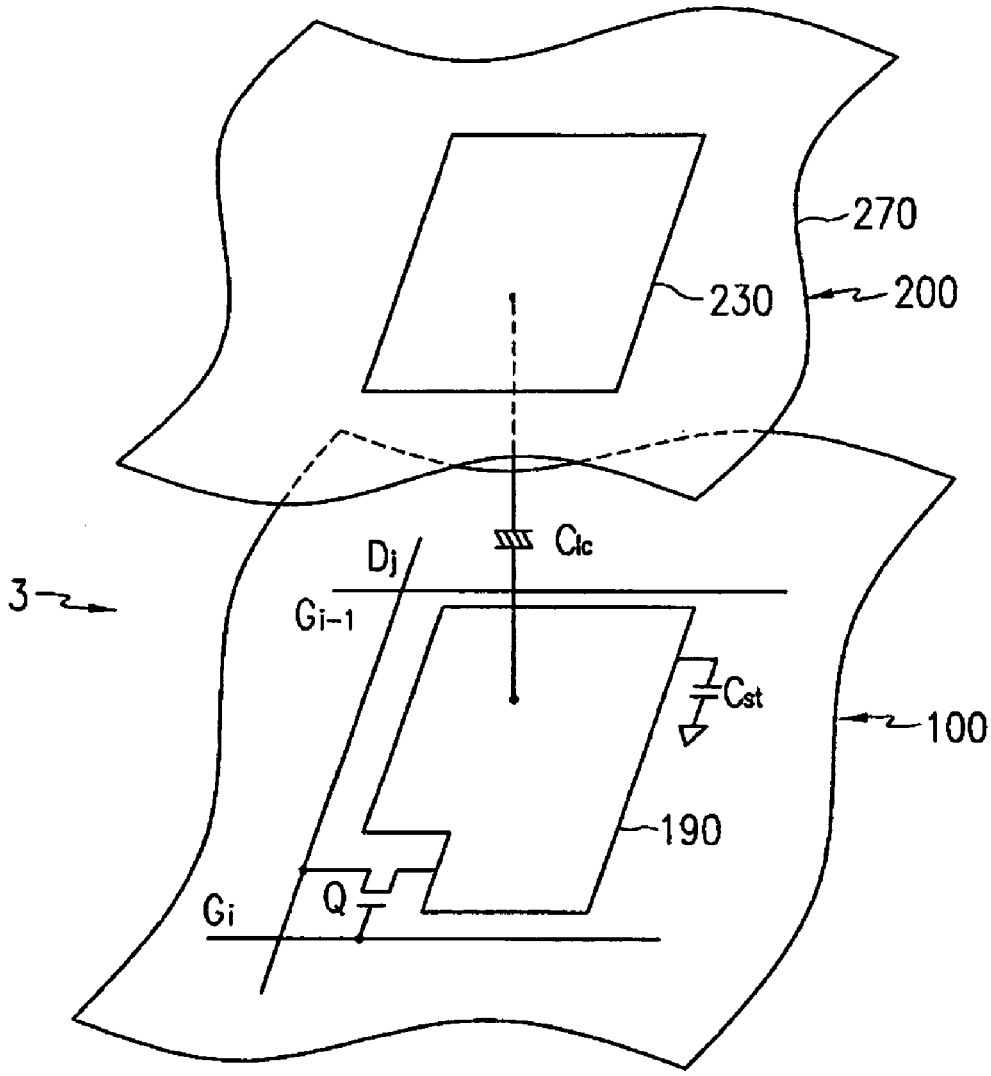
FIG. 3 is a circuit diagram of a pixel of an LCD according to an embodiment of the present invention.

FIG. 1 is a block diagram of an LCD according to an embodiment of the present invention, FIG. 2 is an exploded perspective view of an LCD according to an embodiment of the present invention, and FIG. 3 is a circuit diagram of a pixel of an LCD according to an embodiment of the present invention.

Referring to FIG. 1, an LCD according to an embodiment of the present invention includes an LC panel assembly 300, a gate driver 400, and a data driver 500 that are connected to the panel assembly 300. A gray voltage generator 800 is connected to the data driver 500, a backlight assembly 900, and a signal controller 600. The backlight assembly 900 illuminates the panel assembly 300 and the signal controller 600 controls the other drivers 400, 500 and the panel assembly 300.

As shown in FIG. 2, the LCD according to an embodiment of the present invention includes an LC module 350 including a display unit 330 and the backlight assembly 900, and a pair of front and rear casings 361 and 362 for holding the LC module 350.

The display unit 330 includes the panel assembly 300, a plurality of gate flexible printed circuit (FPC) films 410 and a plurality of data FPC films 510 attached to the panel assembly 300, and a gate printed circuit board (PCB) 450 and a data PCB 550 attached to the associated FPC films 410 and 510, respectively.

As shown in FIG. 3, the panel assembly 300 includes a lower panel 100, an upper panel 200, and a liquid crystal layer 3 interposed therebetween. The panel assembly 300 further includes a plurality of display signal lines $G_1$–$G_n$ and $D_1$–$D_m$ (see FIG. 1), each of which is connected to one of a plurality of pixels that are arranged substantially in a matrix. The display signal lines $G_i$ and $D_j$ refer to a random ones of the display signal lines $G_1$–$G_n$ and $D_1$–$D_m$, respectively.

The display signal lines $G_1$–$G_n$ and $D_1$–$D_m$ are provided on the lower panel 100 and include a plurality of gate lines $G_1$–$G_n$ transmitting gate signals (called scanning signals) and a plurality of data lines $D_1$–$D_m$ transmitting data signals. The gate lines $G_1$–$G_n$ extend substantially parallel to one other, and the data lines $D_1$–$D_m$ extend substantially parallel to one other in a direction that is substantially perpendicular to the direction of the gate lines $G_1$–$G_n$.

Each pixel includes a switching element Q connected to the display signal lines $G_1$–$G_n$ and $D_1$–$D_m$, and an LC capacitor $C_{LC}$ connected to the switching element Q. Some embodiments also include a storage capacitor $C_{ST}$. The switching element Q, which may include a TFT, is provided on the lower panel 100 and has three terminals: a control terminal connected to one of the gate lines $G_1$–$G_n$; an input terminal connected to one of the data lines $D_1$–$D_m$; and an output terminal connected to the LC capacitor $C_{LC}$ and the storage capacitor $C_{ST}$.

The LC capacitor $C_{LC}$ includes a pixel electrode 190 on the lower panel 100, a common electrode 270 on the upper panel 200, and the LC layer 3 as a dielectric between the electrodes 190 and 270. The pixel electrode 190 is connected to the switching element Q, and the common electrode 270 covers the entire surface of the upper panel 100 and is supplied with a common voltage $V_{com}$. Alternatively, both the pixel electrode 190 and the common electrode 270 are provided on the lower panel 100. The pixel electrode 190 is not limited to the shape shown in FIG. 3.

The storage capacitor $C_{ST}$ is an auxiliary capacitor for the LC capacitor $C_{LC}$. In one embodiment, the storage capacitor $C_{ST}$ includes the pixel electrode 190 and a separate signal line (not shown) that is provided on the lower panel 100. The storage capacitor $C_{ST}$ is positioned over the pixel electrode 190, and is supplied with a predetermined voltage such as the common voltage $V_{com}$. In an alternative embodiment, the storage capacitor $C_{ST}$ includes the pixel electrode 190 and an adjacent gate line which is positioned over the pixel electrode 190 and separated from the pixel electrode 190 by an insulation layer.

For a color display, each pixel represents a color, typically one of red, green, and blue. The colors are implemented by placing color filters 230 over an area occupied by the pixel electrode 190. The color filter 230 shown in FIG. 3 is provided on the upper panel 200. However, in other embodiments, the color filter 230 may be provided on or under the pixel electrode 190, on the lower panel 100.

Referring to FIG. 2, the backlight assembly 900 includes a plurality of lamp subunits 911–914 positioned to illuminate the panel assembly 300, a light guide 342, and a plurality of optical sheets 343 disposed between the panel assembly 300 and the lamp subunits 911–914 for guiding and diffusing the light from the lamp subunits 911–914. There is also a reflector 344 disposed near the lamp subunits 911–914 to reduce light leakage by reflecting the light from the lamp subunits 911–914 toward the panel assembly 300. The lamp subunits 911–914 preferably include fluorescent lamps such as CCFL (cold cathode fluorescent lamp) and EEFL (external electrode fluorescent lamp). The lamp subunits 911–914 may also be an LED array.

Referring back to FIG. 1, the backlight assembly 900 includes lamp subunits 911–914 for illuminating the panel assembly 300, an inverter 920 connected to the lamp subunits 911–914, and current restricting subunits 941–944 that are each connected to one of the lamp subunits 911–914. A current sensing unit 950 is connected to the output ends of the current restricting subunits 941–944. The output of the current sensing unit 950 an inverter controller 930 is connected to the current sensing unit 950 and the inverter 920. The inverter 920, the lamp subunits 911–914, the current restricting subunits 941–944, the current sensing unit 950, and the inverter controller 930 may be mounted on a stand-alone inverter PCB (not shown), on the gate PCB 450 or the data PCB 550.

Although not shown, a pair of polarizers for polarizing the light from the lamp subunits 911–914 are attached to the outer surfaces of the panels 100 and 200.

Referring to FIGS. 1 and 2, the gray voltage generator 800 on the data PCB 550 generates two sets of gray voltages related to the transmittance of the pixels. The gray voltages in one set have a positive polarity with respect to the common voltage $V_{com}$, while those in the other set have a negative polarity with respect to the common voltage $V_{com}$.

The gate driver 400 preferably includes a plurality of integrated circuit (IC) chips mounted on the respective gate FPC films 410. The gate driver 400 is connected to the gate lines $G_1$–$G_n$ of the panel assembly 300 and synthesizes the "on" voltage $V_{on}$ and the "off" voltage $V_{off}$ from the driving voltage generator 700 to generate gate signals for application to the gate lines $G_1$–$G_n$.

The data driver 500 preferably includes a plurality of IC chips mounted on the respective data FPC films 510. The data driver 500 is connected to the data lines $D_1$–$D_m$ of the panel assembly 300. The data driver 500 selects the appropriate gray voltage for each of the data lines $D_1$–$D_m$ from the gray voltage generator 800, and applies the selected gray voltages to the data lines $D_1$–$D_m$.

According to another embodiment of the present invention, the IC chips of the gate driver 400 and/or the data driver 500 are mounted on the lower panel 100. In yet another embodiment, one or both of the drivers 400 and 500 are incorporated into the lower panel 100. In both of these embodiments, the gate PCB 450 and/or the gate FPC films 410 are optional and may be omitted.

The signal controller 600 for controlling the drivers 400 and 500 is provided on the data PCB 550 or the gate PCB 450.

Now, the operation of the LCD will be described in detail.

The signal controller 600 is supplied with red, green, and blue image signals R, G, and B, and input control signals from an external graphic controller (not shown). The input control signals include a vertical synchronization signal $V_{sync}$, a horizontal synchronization signal $H_{sync}$, a main clock MCLK, and a data enable signal DE. The signal controller 600 processes the image signals R, G, B to generate R', G', and B' based on the input control signals, and generates the gate control signals CONT1 and data control signals CONT2. The gate control signals CONT1 are forwarded to the gate driver 400 while the processed image signals R', G' and B' and the data control signals CONT2 are forwarded to the data driver 500.

The gate control signals CONT1 include a vertical synchronization start signal STV for indicating the start of a frame, a gate clock signal CPV for controlling the output time of the gate-on voltage $V_{on}$, and an output enable signal OE for defining the duration of the voltage $V_{on}$. The data control signals CONT2 include a horizontal synchronization start signal STH for informing the start of a horizontal period, a load signal LOAD or TP for instructing to apply the data voltages to the data lines $D_1$–$D_m$, an inversion control signal RVS for reversing the polarity of the data voltages (with respect to the common voltage $V_{com}$), and a data clock signal HCLK.

The data driver 500 receives a packet of the image data R', G', and B' for a pixel row from the signal controller 600 and converts the image data R', G' and B' into the corresponding analog data voltages selected from the gray voltages in response to the data control signals CONT2. As stated above, the gray voltages are supplied by the gray voltage generator 800. Thereafter, the data driver 500 applies the data voltages to the data lines $D_1$–$D_m$.

In response to the gate control signals CONT1 from the signals controller 600, the gate driver 400 applies the gate-on voltage $V_{on}$ to the gate line $G_1$–$G_n$, thereby turning on the switching elements Q connected thereto. The data voltages applied to the data lines $D_1$–$D_m$ are supplied to the pixels through the activated switching elements Q.

The difference between the data voltage and the common voltage $V_{com}$ applied to a pixel is expressed as the charged voltage of the LC capacitor $C_{LC}$, also referred to as a pixel voltage. The liquid crystal molecules have orientations depending on the magnitude of the pixel voltage and the orientations determine the polarization of light passing through the LC capacitor $C_{LC}$. The polarizers polarize the light to control light transmittance.

By repeating this procedure by a unit of a horizontal period (which is indicated by 1H and equal to one period of the horizontal synchronization signal Hsync, the data enable signal DE, and a gate clock signal), all gate lines $G_1$–$G_n$ are sequentially supplied with the gate-on voltage $V_{on}$ during a frame, thereby applying the data voltages to all pixels. When the next frame starts after finishing one frame, the inversion control signal RVS applied to the data driver 500 is controlled such that the polarity of the data voltages is reversed (which is called "frame inversion"). The inversion control signal RVS may be also controlled such that the polarity of the data voltages flowing in a data line in one frame are reversed (which is called "line inversion"), or the polarity of the data voltages in one packet are reversed (which is called "dot inversion").

The inverter 920 converts a DC voltage into an AC voltage, steps up the AC voltage and applies the stepped-up AC voltage to the lamp subunits 911–914 in response to an inverter control signal from the inverter controller 930. Each current restricting subunit 941–944 varies the load to be applied to the corresponding lamp 911–914 based on a current flowing through the lamp unit 911–914.

The current sensing unit 950 senses a current flowing through the corresponding lamp subunits 911–914, and provides a feedback signal VFB for controlling the inverter 920 through the inverter controller 930. The inverter 920 is controlled based on the VFB.

The inverter controller 930 generates inverter control signals ICS for controlling the inverter 920 based on a dimming control voltage $V_{dim}$ from an external device and a feedback signal VFB from the current sensing unit 950. The inverter control signals ICS includes a control signal for controlling on and off durations of the lamp subunits 911–914 depending on the dimming control voltage $V_{dim}$, and another control signal for controlling the current flowing in the lamp subunits 911–914. Concerning the latter control signal, for example, the inverter controller 930 generates a triangular carrier signal and pulse width modulates (PWMs) a reference signal based on the carrier signal to generate the control signal. For descriptive convenience, the reference numeral ICS is considered to indicate the latter control signal. The inverter controller 930 varies the level of the reference signal based on the feedback signal VFB to change the pulse width of the control signal ICS so that the total current flowing through the lamp subunits 911–914 is constant.

The inverter controller 930 receives the dimming control voltage $V_{dim}$ from a separate input device either directly or through the signal controller 600.

The operations of the current restricting subunits 941–944 and the current sensing unit 950 will be described in detail with reference to FIGS. 4 to 6A and 6B.

Figure 4:
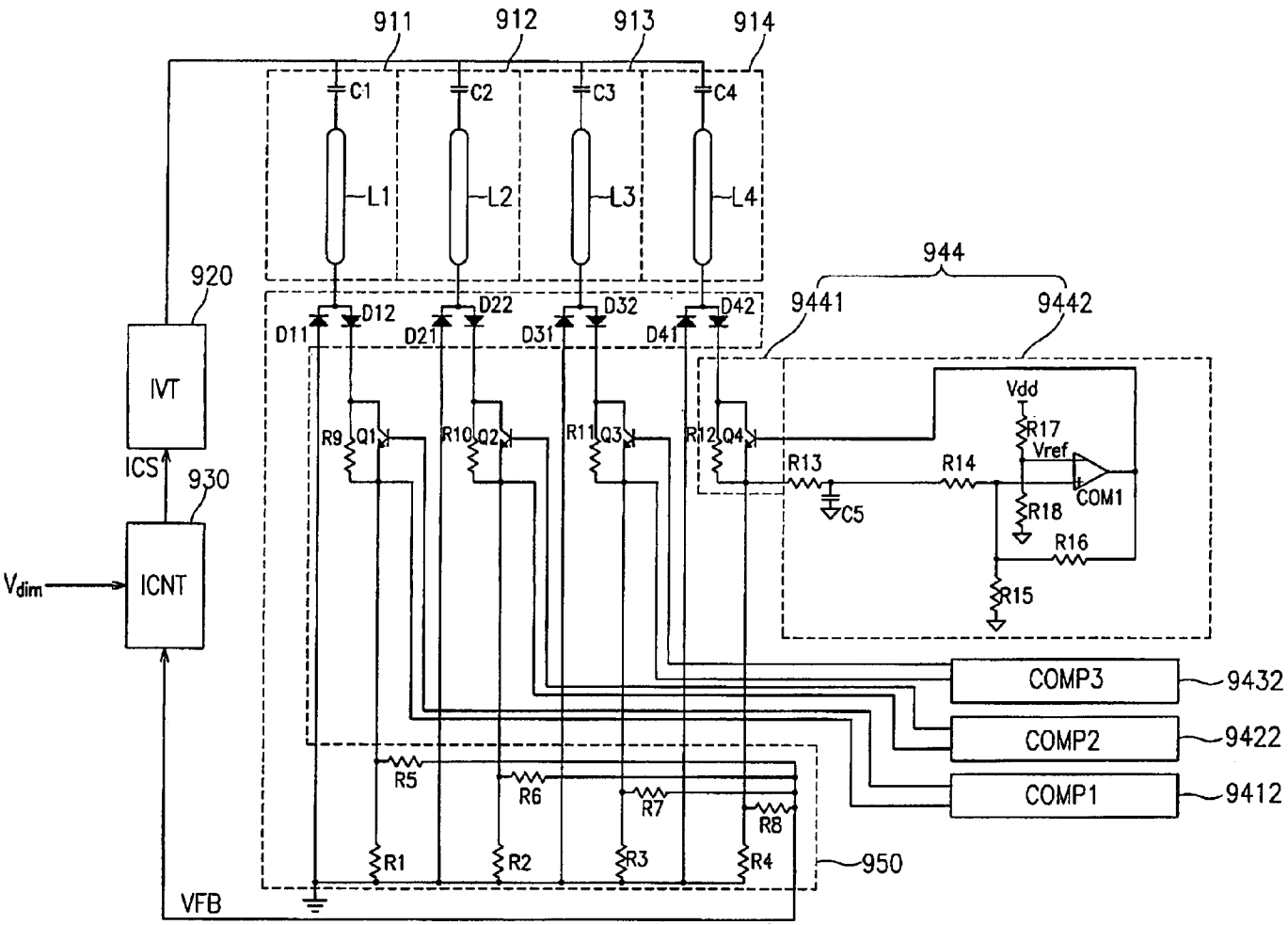
FIG. 4 is a circuit diagram of a lighting unit according to an embodiment of the present invention.
Figure 5:
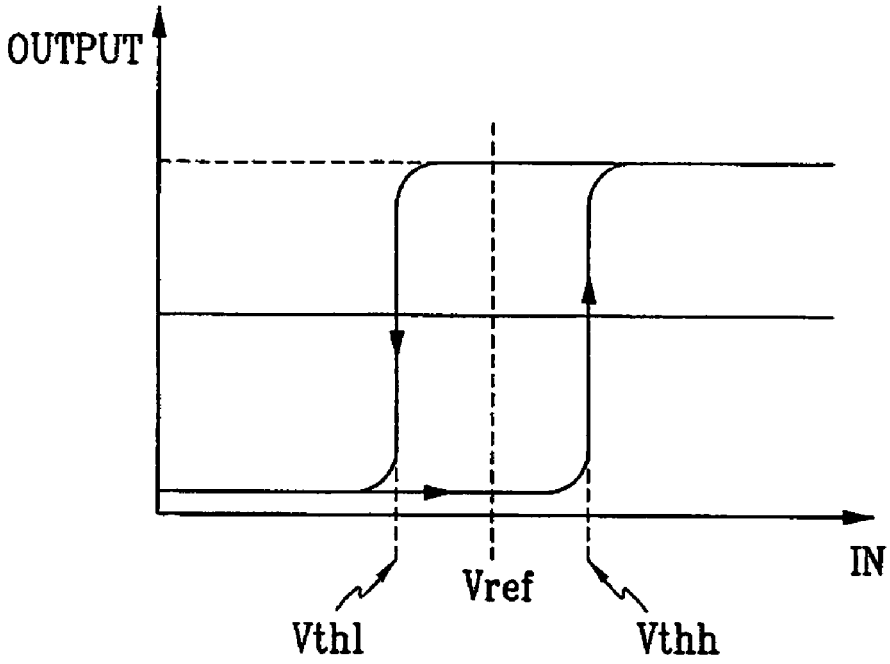
FIG. 5 is a graph illustrating an output signal of a comparator as function of an input voltage thereof according to an embodiment of the present invention.
Figure 6A:
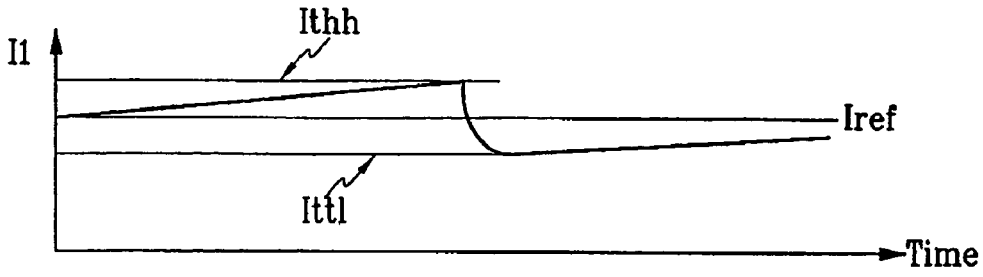
FIGS. 6A and 6B are graphs respectively illustrating currents flowing in lamps according to an embodiment of the present invention.
Figure 6B:
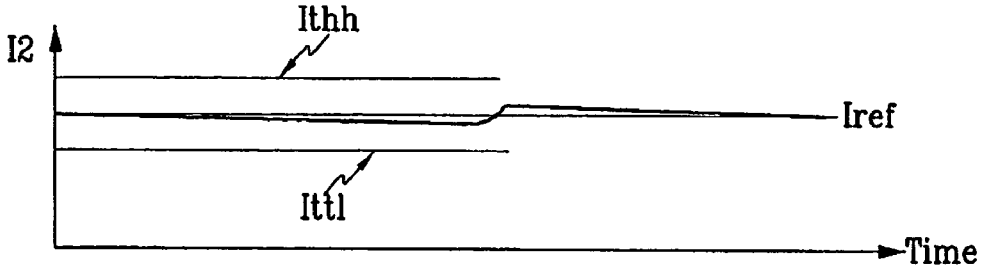

FIG. 4 is an exemplary circuit diagram of a backlight assembly 900 according to an embodiment of the present invention, and FIG. 5 is a graph illustrating an output signal of an exemplary comparator as function of an input voltage. Furthermore, FIGS. 6A and 6B are graphs respectively illustrating a current flowing through a lamp and varying based on the hysteresis characteristic according to an embodiment of the present invention.

As shown in FIG. 4, each of the lamp subunits 911–914 includes a lamp L1–L4 and a capacitor C1–C4 connected between the inverter 920 and the lamp L1–L4. According to an embodiment of the invention, each capacitor C1–C4 is a ballast capacitor, and each lamp L1–L4 is a cold cathode fluorescent lamp (CCFL). Each ballast capacitor C1–C4 may have a capacitance 2 to 5 times larger than that of a normal ballast capacitor, and thus a transformer (not shown) in the inverter 920 may generate a relatively low voltage to be applied to the ballast capacitor C1–C4.

A current sensing unit 950 includes a plurality of pairs of diodes D11 and D12, D21 and D22, D31 and D32, and D41 and D42, a plurality of current sensing resistors R1–R4, and a plurality of additional resistors R5–R8. As shown in FIG. 4, each pair of the diodes D11 and D12, D21 and D22, D31 and D32, and D41 and D42 are connected in parallel to the lamp unit 911–914, in the opposite direction. The current sensing resistors R1–R4 are connected between the diodes D12, D22, D32 and D42 in a forward direction from the lamp subunits 911–914 and a ground. The additional resistors R5–R8 are connected in parallel between the current sensing resistors R1–R4 and the inverter controller 930.

Current restricting subunits 941–944 have substantially the same configuration. For example, the current restricting subunit 944 includes a selection block 9441 including a current restricting resistor R12 and a switching element Q4 connected in parallel and a comparing block 9442 connected to the selection block 9441. Reference numerals 9412, 9422 and 9432 indicate comparing blocks (COMP1–COMP3) of the restricting units 941–943, respectively.

The resistors R9–R12 and the switching elements Q1–Q4 are connected between the diodes D12, D22, D32 and D42 and the current sensing resistors R1–R4, respectively. Each switching element Q1–Q4 is a bipolar transistor having a collector connected to the diode D12, D22, D32 or D42, an emitter connected to the current sensing resistor R1–R4, and a base connected to the comparing block 9442. The switching elements Q1–Q4 may be MOS transistors.

The comparing block 9442 includes a comparator COM1 functioning as a Schmitt trigger having a hysteresis characteristic and having a non-inverting terminal (+) and an inverting terminal (−), a voltage divider for generating a reference voltage Vref to be supplied to the inverting terminal (−) of the comparator COM1, and an RC circuit for smoothing a voltage supplied to the non-inverting terminal (+) of the comparator COM1. The RC circuit includes a resistor R13 and a capacitor connected between the resistor R13 and a ground and it is connected to the non-inverting terminal (+) of the comparator COM1 through an input resistor R14. The voltage divider includes a pair of resistors connected in series between a supply voltage Vdd and a predetermined voltage such as a ground. The comparator COM1 has a positive feedback connection through a feedback resistor R 16 and a resistor R15 is connected between the non-inverting terminal (+) and a predetermined voltage such as a ground. The comparator COM1 may be a non-inverting type hysteresis comparator.

Now, the operations of the above elements 941–944 and 950 will be described.

When an ignition voltage from the inverter 920 is applied to the first to fourth lamp subunits 911–914, the lamps L1–L4 are turned on by the capacitors C1–C4.

Since the ignition voltage applied to the lamp subunits 911–914 is higher than a normal operation voltage applied to the lamp subunits 911–914, an initial voltage applied to the non-inverting terminal (+) of the comparator COM1 is higher than the reference voltage Vref applied to the inverting terminal (−) of the comparator COM1. Accordingly, the output of the comparator COM1 to be applied to the control terminal, i.e. the base of the switching element Q4 has a high value, and thus the switching element Q4 is turned on to form a current path from the lamp L4.

The capacitor C1–C4 functions as a load for restricting current in the lamp 21–24 to prevent overcurrent.

As a result, the current from the lamp unit 911–914 is half-wave rectified by the diode D12, D22, D32 or D42, and the rectified current is applied to the comparing unit 9412, 9422, 9432 or 9442 and the current sensing unit 950 via the switching element Q1–Q4 of the current restricting subunit 941–944.

The half wave alternating current entering the comparing unit 9412, 9422, 9432 or 9442 is smoothed by the RC circuit including the resistor R12 and the capacitor C5 to be converted into a direct current and it is applied to the non-inverting terminal (+) of the comparator COM1.

As the current flowing in one of the lamps L1–L4, for example, the lamp L4 increases as time lapses, the voltage drop by the resistors R13 and R14 increases. Therefore, the voltage applied to the non-inverting terminal (+) of the comparator COM1 decreases and it becomes smaller than the reference voltage. Then, the output of the comparator COM1 to be applied to the base of the transistor Q4 becomes low to turn off the transistor Q4.

Accordingly, the current from the lamp unit 914 flows through the resistor R9–R12 instead of the switching element Q4. Since the resistances of the resistor R9–R12 are larger than the internal resistance of each switching elements Q1–Q4, and thus load exerted on a current path of the lamp unit 914 is larger than load on current paths of the remaining lamp subunits 911–913 connected in parallel. As a result, the current flowing in the lamp L4 decreases due to the increased load.

In the meantime, the current sensing unit 950 senses the respective currents in the lamps L1–L4 flowing through the current restricting subunits 941–944 using the resistors R1–R4, and then it sums the sensed currents of the lamps L1–L4 using the resistors R5–R8. The voltage corresponding to the total of the sensed currents is applied to the inverter controller 930 as a feedback signal VFB.

The inverter controller 930 adjusts the level of a reference voltage based on the feedback signal VFB to control the pulse width of the inverter control signal ICS. Since the inverter controller 930 controls the inverter 920 so that the total current flowing the lamp subunits 911–914 can be constant, the currents flowing in the lamp subunits 911–913 other than the lamp unit 914 becomes increased to compensate the reduced current in the lamp unit 914. The current compensation prevents the flicker phenomenon due to sudden decrease of the current in one or more of the lamp subunits 911–914.

In the meantime, when the current flowing in the lamp unit 914 is decreased by the operation of the current restricting subunits 941–944, the non-inverting input of the comparator COM1 increases, and when the non-inverting input voltage becomes higher than the reference voltage Vref applied to the inverting terminal (−) of the comparator COM1, the output signal of the comparator COM1 is changed from a low state into a high state. Responsive to the output signal from the comparator COM1, the switching element Q4 turns on, and the current path of the lamp unit 914 is changed from the resistor R12 into the switching element Q4.

The current restricting subunits 941–944 according to an embodiment of the present invention control the currents of the lamp subunits 911–914 not to reach a predetermined level, thereby preventing the deterioration of the lamps L1–L4 due to over-current.

A comparator COM1 as well as the resistors R15 and R16 used for a comparing unit according to an embodiment of the present invention has the hysteresis characteristic as shown in FIG. 5, which is a graph illustrating an output signal of a comparator as function of an input voltage. That is, the output of the comparator COM1 is different between an increasing non-inverting input and a decreasing non-inverting input. In detail, a current restriction establishment voltage Vthh at which the output of the comparator COM1 changes from a low state to a high state is higher than a current restriction release voltage Vthl at which the output of the comparator COM1 changes from a high state to a low state. The hysteresis characteristic of the comparator COM1 reduces noises and unstable operation due to frequent operation changes between the current restriction state and the normal current state.

FIGS. 6A and 6B is graphs illustrating the current variation in a lamp having increasing current and another lamp.

As shown in FIGS. 6A and 6B, when the current I1 in a lamp increases to reach a predetermined level Ithh corresponding to the current restriction establishment voltage Vthh, the current I1 rapidly decreases by the operation of the comparing block 9442 to reach a predetermined level Ith1 corresponding to the current restriction release voltage Vth1 and then it gradually increases again. At this time, the current I2 in another lamp decreases during the increase of the current I1, rapidly increases during the rapid decrease of the current I1, and gradually decreases during the gradual increase of the current as shown in FIG. 6B.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An apparatus for controlling a light assembly, the apparatus comprising;

a lamp unit having a load;

a current restricting unit that changes a path of a current flowing through the lamp unit when an amount of the current is larger than a predetermined magnitude, so as to adjust the load on the lamp unit, wherein the current restricting unit is coupled to the lamp unit;

a current sensing unit that determines a total current flow through the lamp unit, wherein the current sensing unit is coupled to the current restricting unit; and a current control unit that adjusts a current supply to the lamp unit based on the total current flow.

2. The apparatus of claim 1, wherein the current restricting unit comprises:

a comparing block that compares a voltage at an output end of the lamp unit against a reference voltage; and a selection block that directs a current from the lamp unit to the comparing block, wherein the selection block is coupled to the comparing block and the current sensing unit.

3. The apparatus of claim 2, wherein the selection block directs the current from the lamp unit to at least one of the comparing block and the current sensing unit, depending on at least one of a magnitude of the current from the lamp output and a time period during which the magnitude is sustained.

4. The apparatus of claim 2, wherein the selection block comprises:

a switching element; and a current restricting resistor connected to the lamp output in parallel with the switching element, the switching element configured to turn on and off based on a signal from the comparing block, such that current flows to the current sensing unit when the switching element is turned on.

5. The apparatus of claim 2, wherein the selection block comprises:

a current restricting resistor; and a transistor having a collector, a base, and an emitter, wherein the current resisting resistor and the transistor are coupled to the lamp unit in parallel, such that the collector is coupled to the lamp unit, the base is coupled to the comparing block, and the emitter is coupled to the current sensing unit.

6. The apparatus of claim 5, wherein the comparing block comprises a comparator coupled to the lamp, the comparator having a first input, a second input, and a comparator output, wherein the reference voltage is coupled to the first input and the comparator output is coupled to the base of the transistor, such that a state of the transistor depends on a relative value of the voltage at the first input and the second input.

7. The apparatus of claim 6 further comprising a voltage divider that generates the reference voltage at the first input of the comparator.

8. The apparatus of claim 6 further comprising an RC circuit coupled to the second input.

9. The apparatus of claim 6 further comprising a feedback loop connecting the comparator output to the second input, the feedback loop comprising a feedback resistor.

10. The apparatus of claim 9 further comprising an additional resistor connected between the feedback loop and a node having a predetermined voltage.

11. The apparatus of claim 6, wherein the comparator is a non-inverting hysterisis comparator.

12. The apparatus of claim 2, wherein the selection block further comprises a current restricting resistor coupled to the lamp output and the second input of the comparator.

13. The apparatus of claim 2, wherein the selection block increases the load on the lamp unit in response to the total current flow's exceeding a predetermined magnitude for a predetermined time period.

14. The apparatus of claim 1, wherein the current sensing unit comprises a diode unit coupled to the lamp unit for generating a half-wave rectified voltage at an output of the lamp unit and forwarding the half-wave-rectified voltage to the selection block

15. The apparatus of claim 14, wherein the diode unit comprises a first diode and a second diode that are connected to the lamp unit in parallel, the first diode allowing current to flow into the lamp unit and the second diode allowing current to flow out of the lamp unit and to the selection block.

16. The apparatus of claim 1, wherein:

the lamp unit includes a first lamp and a second lamp coupled in a parallel configuration, the current restricting unit includes a first current restricting subunit that is coupled to the first lamp and a second current restricting subunit that is coupled to the second lamp, and the current sensing unit includes a first current sensing subunit that is coupled to the first lamp and a second current sensing subunit that is coupled to the second lamp, the apparatus further comprising:

a first capacitor coupled to an input to one of the lamps; and a second capacitor coupled to an input to another one of the lamps, wherein the first capacitor and the second capacitor control magnitudes of current flowing into the respective lamps.

17. The apparatus of claim 16, wherein the first current restricting subunit includes a first switching element and the second current restricting subunit includes a second switching element, further comprising:

a first sensing resistor coupled to the first switching element and a node of a predetermined voltage;

a second sensing resistor coupled to the second switching element and the node of the predetermined voltage;

a first summing resistor coupled to the first switching element and the current control unit; and a second summing resistor coupled to the second switching element and the current control unit, such that the current control unit receives a sum of current from the first switching element and current from the second switching element, the sum indicating the total current flow through the lamp unit.

18. The apparatus of claim 17, wherein the current controlling unit comprises an inverter that controls the current supply to the lamp input.

19. The apparatus of claim 18, wherein the current controlling unit further comprises an inverter controller that generates an adjusted current supply signal based on the total current flow from the first and the second summing resistors, and forwarding the adjusted current supply signal to the inverter.

20. The apparatus of claim 19, wherein the inverter controller generates the adjusted current supply signal based on maintaining a substantially constant current flowing through the first and the second lamps.

21. An apparatus for controlling a light assembly, the apparatus comprising:

a first lamp and a second lamp coupled in a parallel configuration;

a first current restricting subunit that is coupled to the first lamp and changes a path of a first current flowing through the first lamp when an amount of the first current is larger than a predetermined magnitude, so as to adjust a first load on the first lamp, and a second current restricting subunit that is coupled to the second and changes a path of a second current flowing through the second lamp when an amount of the second current is larger than the predetermined magnitude, so as to adjust a second load on the second lamp;

a first current sensing subunit that is coupled to the first lamp for determining a first current flow through the first lamp and a second current sensing subunit that is coupled to the second lamp for determining a second current flow through the second lamp; and a current control unit that sums the first current flow and the second current flow to generate a total current flow, and adjusts a current supply to the first lamp and the second lamp based on the total current flow.

22. The apparatus of claim 21, wherein the first current restricting subunit comprises:

a first comparing unit that compares a voltage at an output end of the first lamp against a reference voltage, the first comparing unit including a first comparator having a first inverting input, a first noninverting input, and a first comparator output; and a first selection block coupled to the first comparing unit; and the second current restricting subunit comprises:

a second comparing unit that compares a voltage at an output end of the second lamp against the reference voltage, the second comparing unit including a second comparator having a second inverting input, a second noninverting input, and a second comparator output; and a second selection block coupled to the second comparing unit.

23. The apparatus of claim 22, wherein the first selection block comprises a first switching element that is configured to adjust the first load on the first lamp in response to the first comparator output; and the second selection block comprises a second switching element that is configured to adjust the second load on the second lamp in response to the second comparator output.

24. The apparatus of claim 22, wherein the reference voltage is coupled to the first inverting input and the second inverting input, the first comparing unit further comprising:

a first RC circuit coupled to the first noninverting input; and a first feedback loop connecting the first comparator output to the first noninverting input, the first feedback loop including a first feedback resistor; and the second comparing unit further comprising:

a second RC circuit coupled to the second noninverting input; and a second feedback loop connecting the second comparator output to the second noninverting input, the second feedback loop including a second feedback resistor.

25. The apparatus of claim 22, wherein the first selection block is coupled to a first summing resistor and the second selection block is coupled to a second summing resistor, wherein the first summing resistor and the second summing resistor are coupled to a feedback loop to the current control unit.

26. A method of controlling a light assembly, the method comprising:

monitoring a current output from each of a plurality of lamps;

increasing a load on one of the lamps upon detecting a current output exceeding a first predetermined magnitude for at least a predetermined time period;

summing the current output from each of the plurality of lamps to determine a total current flow through the lamps; and adjusting a current input to the lamps based on the total current flow;

wherein a path of a current flowing through each of the lamps is changed when an amount of the current is larger than a second predetermined magnitude.

27. A display apparatus comprising:

a liquid crystal panel assembly; and a light assembly coupled to the liquid crystal panel assembly, the light assembly including:

a lamp unit;

a current restricting unit that changes a path of a current flowing through the lamp unit when an amount of the current is larger than a predetermined magnitude, so as to adjust a load on the lamp unit, wherein the current restricting unit is coupled to the lamp unit;

a current sensing unit that determines a total current flow through the lamp unit, wherein the current sensing unit is coupled to the current restricting unit; and a current control unit that adjusts a current supply to the lamp unit based on the total current flow.

* * * * *